US009302514B2

(12) United States Patent
Goren et al.

(10) Patent No.: US 9,302,514 B2
(45) Date of Patent: Apr. 5, 2016

(54) ADJUST A POSITION OF A PRINTHEAD RELATIVE TO A PRINTBAR BEAM MEMBER

(71) Applicant: Hewlett-Packard Industrial Printing Ltd., Netanya (IL)

(72) Inventors: Adam Goren, Netanya (IL); Chen Turkenitz, Ramat Hasharon (IL)

(73) Assignee: Hewlett-Packard Industrial Printing Ltd, Netanya (IL)

( * ) Notice: Subject to any disclaimer, the term of this patent is extended or adjusted under 35 U.S.C. 154(b) by 0 days.

(21) Appl. No.: 14/656,358

(22) Filed: Mar. 12, 2015

(65) Prior Publication Data

US 2015/0258824 A1 Sep. 17, 2015

(30) Foreign Application Priority Data

Mar. 14, 2014 (EP) ..... 14275064

(51) Int. Cl.

| | |
|---|---|
| ***B41J 2/14*** | (2006.01) |
| ***B41J 23/00*** | (2006.01) |
| ***B41J 25/34*** | (2006.01) |
| ***B25B 13/06*** | (2006.01) |
| ***B41J 2/155*** | (2006.01) |
| ***B41J 25/308*** | (2006.01) |
| ***B41J 25/316*** | (2006.01) |
| ***B25B 13/50*** | (2006.01) |

(52) U.S. Cl.

CPC ..... *B41J 25/34* (2013.01); *B25B 13/065* (2013.01); *B25B 13/50* (2013.01); *B41J 2/155* (2013.01); *B41J 25/3086* (2013.01); *B41J 25/316* (2013.01)

(58) Field of Classification Search

CPC ..... B41J 25/304; B41J 25/34; B41J 2/155; B41J 2202/20; B41J 2202/14; B41J 2/1752; B41J 29/02; B41J 2/04505

USPC ..... 347/20, 37, 40, 49

See application file for complete search history.

(56) References Cited

U.S. PATENT DOCUMENTS 8,425,007 B2 * 4/2013 Essen ..... 347/49

FOREIGN PATENT DOCUMENTS

FR 2761630 A1 10/1998
WO WO-2009/142927 A1 11/2009

OTHER PUBLICATIONS

International Search Report and Written Opinion dated Jun. 26, 2014, issued on European Patent Application No. 14275064.5 filed Mar. 14, 2014, European Patent Office.

* cited by examiner

*Primary Examiner* — An Do
(74) *Attorney, Agent, or Firm* — HP Inc Patent Department

(57) ABSTRACT

A printhead assembly, a printhead alignment tool usable with a printhead assembly, and a method of aligning a misaligned printhead are disclosed. The printhead assembly includes a printhead disposed on a printbar beam member. A position of the printhead may be adjusted relative to a printbar beam member.

15 Claims, 13 Drawing Sheets

ADJUST A POSITION OF A PRINTHEAD RELATIVE TO A PRINTBAR BEAM MEMBER

CLAIM FOR PRIORITY

The present application claims the benefit of priority to European patent application number 14275064.5 having a filing date of Mar. 14, 2014, the disclosure of which is hereby incorporated by reference in its entirety.

BACKGROUND

A printhead assembly may include a printbar beam member and a plurality of printheads. The printheads may be spaced apart from each other along the printbar beam member. The printbar beam member may extend across a print zone including a width of media. The printheads may apply fluid onto the media to form images thereon.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Printers such as inkjet page wide printers may include printhead assemblies that include a printbar beam member and a plurality of printheads disposed thereon. The printbar beam member extends across a print zone including a width of media. The printheads apply fluid such as ink onto media to form images thereon. The printheads are spaced apart from each other along the printbar beam member. Accurate spacing between printheads assists in reducing print quality defects such as visible strikes and line artifacts. As the span of the printhead assembly increases, for example, to accommodate wider media, the number of printheads on the printbar beam member may also increase. For example, the spacing between end nozzles of adjacent printheads should be within an acceptable range to prevent visible strikes and line artifacts. Thus, errors in the respective spacing between some of the printheads may increase resulting in an increase in print quality defects. Further, the number of defective printheads manufactured outside of acceptable manufacturing tolerances may increase.

In examples, a printhead assembly includes a printbar beam member, a printhead, and a pin assembly. The printbar beam member includes a beam surface and a first cavity disposed through the beam surface. The printhead includes a printhead surface and a second cavity disposed through the printhead surface. The pin assembly includes a bushing disposed in the second cavity and a first eccentric pin. The first eccentric pin is configured to rotate to adjust a position of the printhead relative to the printbar beam member. Thus, errors in the respective spacing between some of the printheads may be reduced by adjusting a position of the printhead relative to the printbar beam member through rotation of the first eccentric pin. Accordingly, print quality defects and the number of defective printheads may be reduced.

Figure 1:
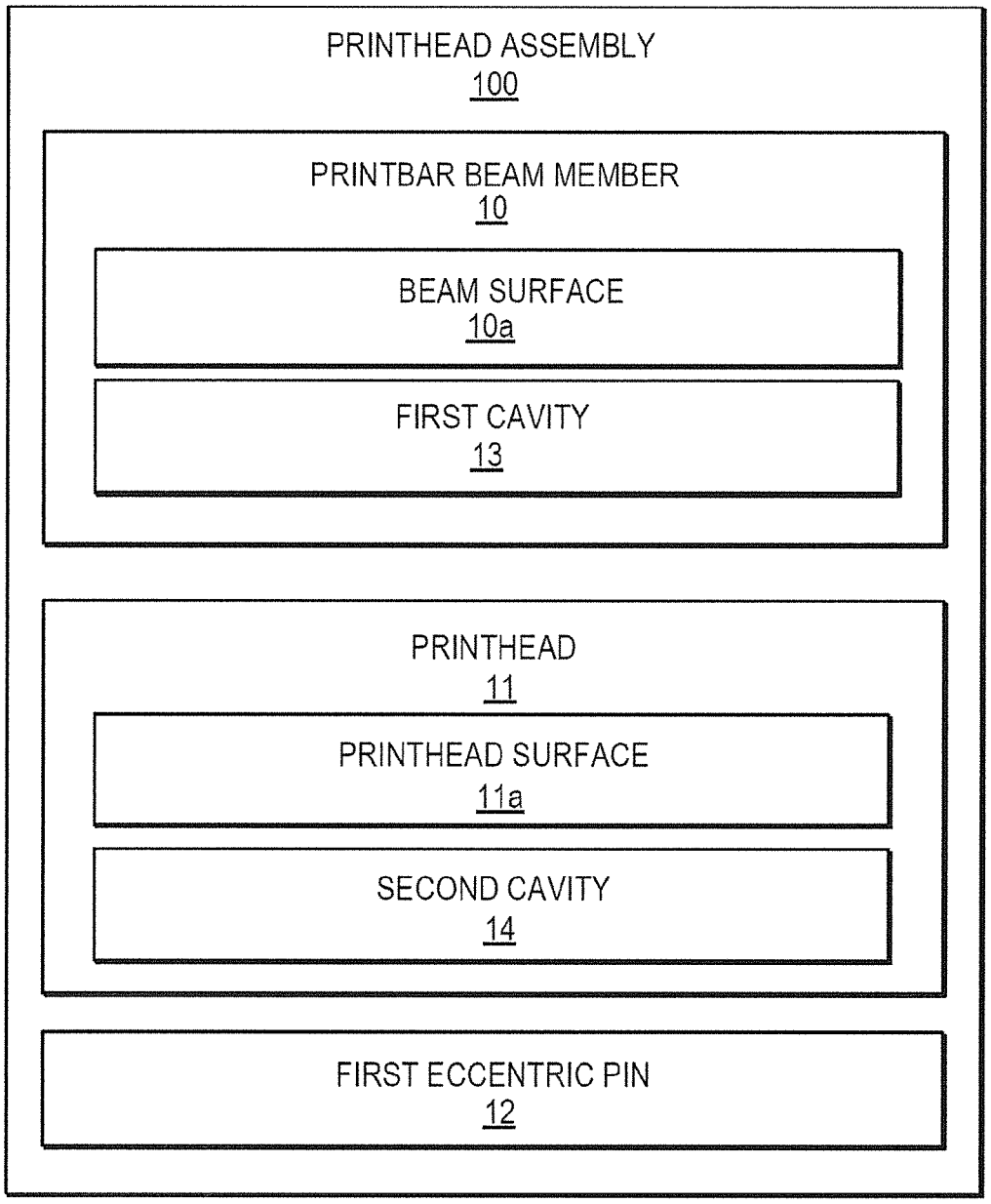
FIG. 1 is a block diagram illustrating a printhead assembly according to an example.

FIG. 1 is a block diagram illustrating a printhead assembly according to an example. Referring to FIG. 1, in some examples, a printhead assembly 100 includes a printbar beam member 10, a printhead 11, and a first eccentric pin 12. An eccentric pin, for example, may have its axis of revolution displaced from its center so that it is capable of imparting reciprocating motion. That is movement of an offset portion (FIG. 4A) of the respective eccentric pin 11 from one position to another position within a respective cavity may provide linear movement to the respective printhead 11. The printbar beam member 10 includes a beam surface 10*a* and a first cavity 13 disposed through the beam surface 10*a*. The printhead 11 includes a printhead surface 11*a* and a second cavity 14 disposed through the printhead surface 11*a*. The printhead surface 11*a*, for example, may be configured to oppose and/or contact the printbar beam member surface 10*a*. The first eccentric pin 12 may be inserted into the first cavity 13 and the second cavity 14 to couple the printhead 11 to the printbar beam member 10.

Referring to FIG. 1, in some examples, the first eccentric pin 12 may rotate to adjust a position of the printhead 11 relative to the printbar beam member 10 along a first axis along the beam surface 10*a*. For example, the first axis may be transverse to a printing direction. In some examples, the printhead 11 may remain on the printbar beam member 10 during rotation of the first eccentric pin 12. Alternatively, the printhead 11 may be removed from the printbar beam member 10 prior to the rotation of the first eccentric pin 12 and placed back on the printbar beam member 10 after completion of the rotation of the first eccentric pin 12. That is, after completion of the rotation of the first eccentric pin 12, the first eccentric pin 12 disposed through the second cavity 14 of the printhead 11 may be reinserted back into the corresponding first cavity 13 of the printbar beam member 10 to place the printhead 11 in a new position (e.g., an alignment state) on the printbar beam member 10. In some examples, the first cavity 13 may include a first hollow sleeve and the second cavity 14 may include a second hollow sleeve.

Figure 2A:
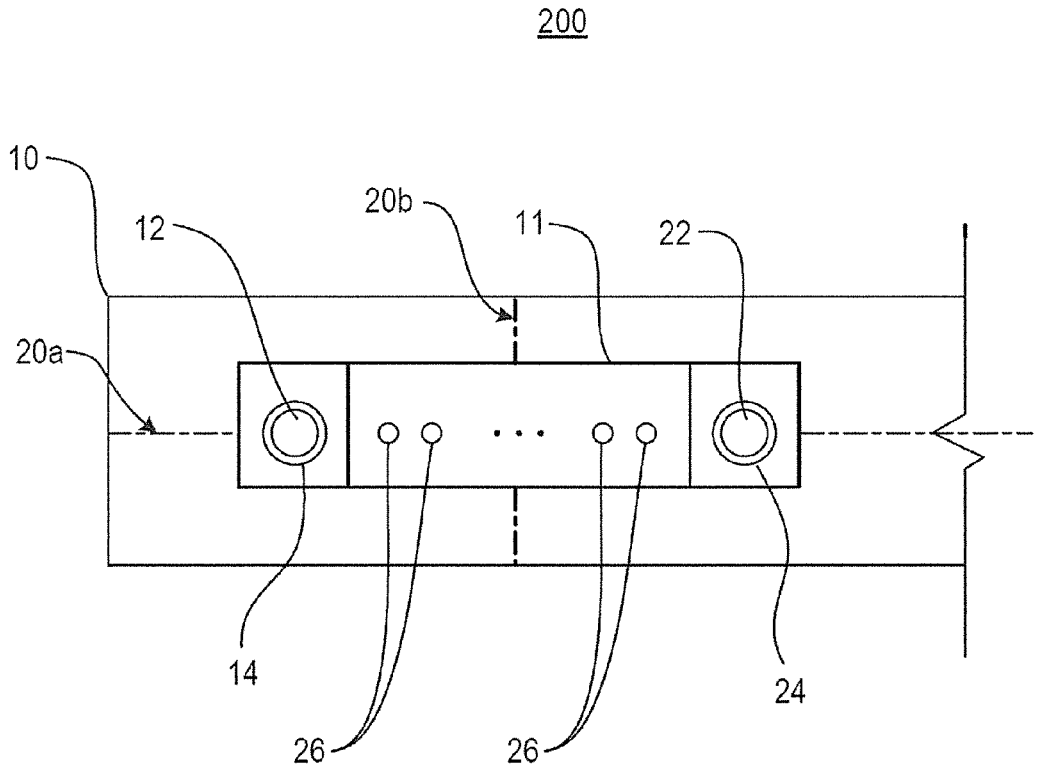
FIG. 2A is a top view illustrating a printhead assembly according to an example.
Figure 2B:
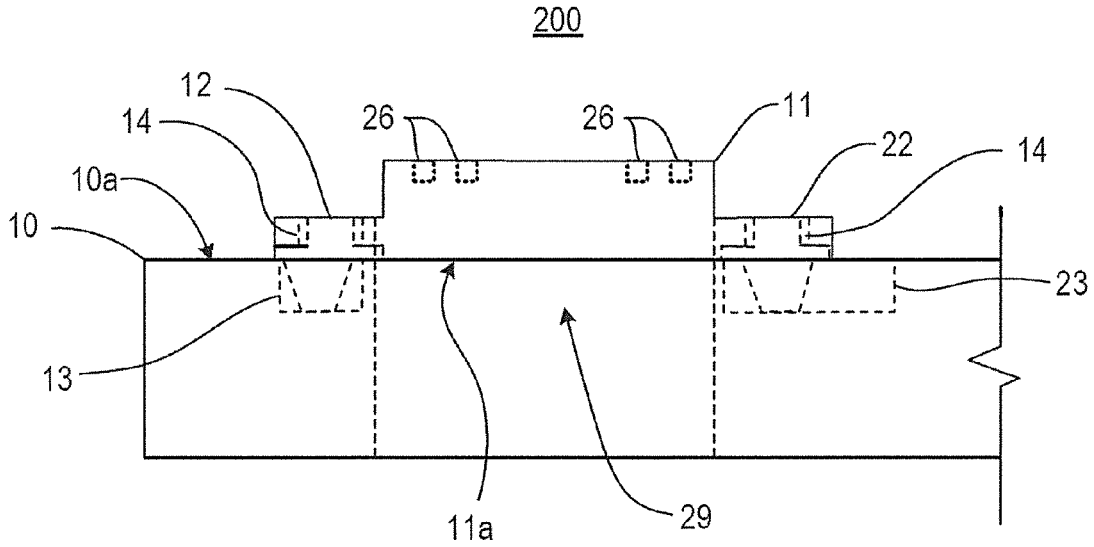
FIG. 2B is a schematic side view illustrating the printhead assembly of FIG. 2A according to an example.
Figure 3:
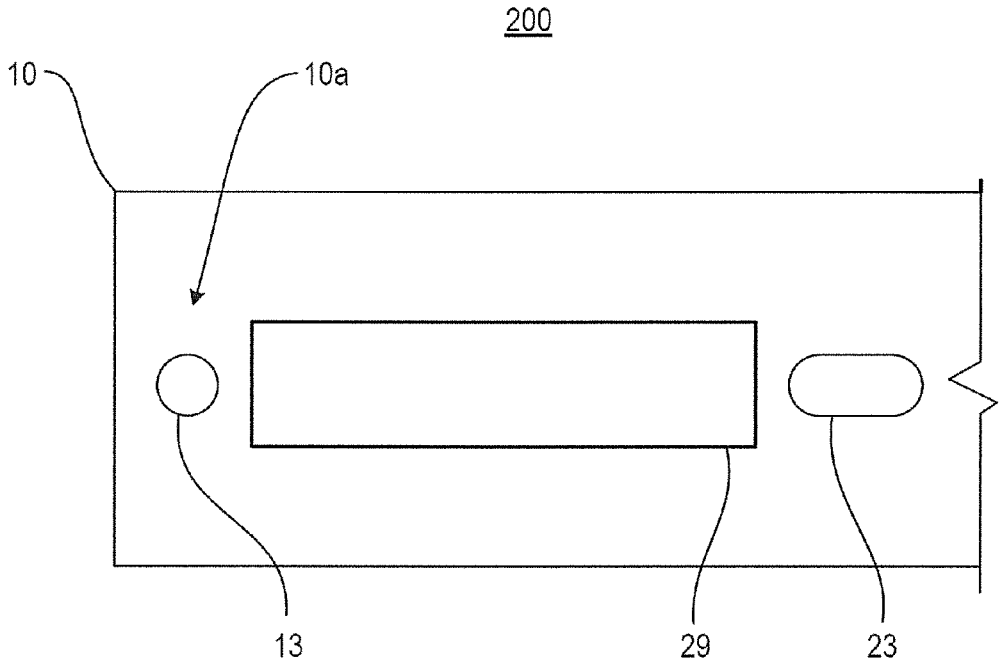
FIG. 3 is a top view illustrating a printbar beam member of the printhead assembly of FIG. 2A according to an example.

FIG. 2A is a top view illustrating a printhead assembly according to an example. FIG. 2B is a schematic side view illustrating the printhead assembly of FIG. 2A according to an example. FIG. 3 is a top view illustrating a printbar beam member of the printhead assembly of FIG. 2A according to an example. In some examples, the printhead assembly 200 may include the printbar beam member 10, the printhead 11, and the first eccentric pin 12 previously described with respect to the printhead assembly 100 of FIG. 1. The first eccentric pin 12 may be rotated to adjust the printhead 11 along the first axis 20*a* of the printbar beam member 10. In doing so, at times, the printhead 11 may also unintentionally be adjusted along the second axis as well (e.g., the printing direction). Referring to FIGS. 2A-3, in some examples, the printhead assembly 200 may also include a second eccentric pin 22. The second eccentric pin 22, for example, may be provided to adjust the printhead 11 along the second axis 20*b* of the printbar beam member 10 (e.g., a printing direction). Additionally, the printbar beam member 10 may also include a third cavity 23 disposed through the beam surface 10*a*, a printhead receiving area 29, and printbar fluid ports (not illustrated).

In some examples, the printbar beam member 10 may include an extrusion beam. Also, the printhead 11 may include a fourth cavity 24 disposed through the printhead surface 11*a*, nozzles 26, and printhead fluid ports (not illustrated). For example, the printhead fluid ports and the printbar fluid ports may be placed in fluid communication with each other when the printhead 11 is installed on the printbar beam member 10 to pass fluid therebetween. Fluid in the printhead 11 may be selectively passed through the respective nozzles 26 of the printhead 11, for example, to form an image on media. In some examples, the fluid is ink.

Referring to FIGS. 2A-3, in some examples, the first eccentric pin 12 may be inserted into the first cavity 13 and the second cavity 14 to couple the printhead 11 to the printbar beam member 10. The first eccentric pin 12 may rotate to adjust a position of the printhead 11 relative to the printbar beam member 10, for example, along a first axis 20*a* along the beam surface 10*a*. In some examples, the first eccentric pin 12 may have eccentricity in a range from −30 microns to 30 microns. That is, the linear range of movement of the printhead 11 imparted by a full rotation of the first eccentric pin 12 may be about sixty microns. Additionally, in some examples, the second eccentric pin 22 may be inserted into the third cavity 23 and the fourth cavity 24 to couple the printhead 11 to the printbar beam member 10*a*.

In some examples, the first cavity 13 may be a first hollow sleeve, the second cavity 14 may be a second hollow sleeve, the third cavity 23 may be a third hollow sleeve, and a fourth cavity 24 may be a fourth hollow sleeve. For example, hollow sleeves may be used to accurately set the distance between a first nozzle of the respective printhead and a center of the hollow sleeve to enable the respective eccentric pins therein to freely rotate. In some examples, the first, second and fourth hollow sleeves may have a circular-shaped opening and the third hollow sleeve may have an oval-shaped opening. For example, the third cavity 23 and/or third hollow sleeve of the printbar beam member 10 may be shaped as an oval such as a slit. The slit may be arranged to direct movement of the printhead 11 in a cross-print direction (along the first axis 20*a*). The slit may also enable the second eccentric pin 22 to adjust the printhead 11 along the second axis 20*a* without unintentionally adjusting it along the first axis 20*b*.

Referring to FIGS. 2A-3, in some examples, the second eccentric pin 22 may rotate to adjust the position of the printhead 11 relative to the printbar beam member 10, for example, along a second axis 20*b* along the beam surface 10*a*. The second axis 20*b* may be different than the first axis 20*b*. In some examples, the second axis 20*b* may be in a printing direction and the first axis 20*a* may be traverse to the printing direction (e.g., cross-print direction). The printhead receiving area 29 may include an oversized compartment to receive the printhead 11 and include space, for example, for it to move in respective directions corresponding to movement of the respective eccentric pins 12 and 22, as desired.

In some examples, the printhead 11 may remain on the printbar beam member 10 during rotation of the first eccentric pin 12 and second eccentric pin 22. Alternatively, the printhead 11 may be removed from the printbar beam member 10 prior to the rotation of the first eccentric pin 12 and the second eccentric pin 22, and placed back on the printbar beam member 10 after completion of the rotation of the respective eccentric pins 12 and 22. For example, after completion of the rotation of the first eccentric pin 12, the first eccentric pin 12 disposed through the second cavity 14 of the printhead 11 may be reinserted back into the corresponding first cavity 13 of the printbar beam member 10 to place the printhead 11 in a new position (e.g., alignment state) on the printbar beam member 10.

Figure 4A:
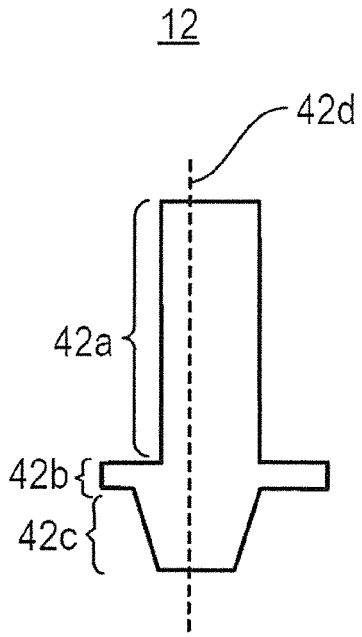
FIGS. 4A and 4B are side views of a first eccentric pin and a second eccentric pin, respectively, of the printhead assembly of FIG. 2A according to examples.
Figure 4B:
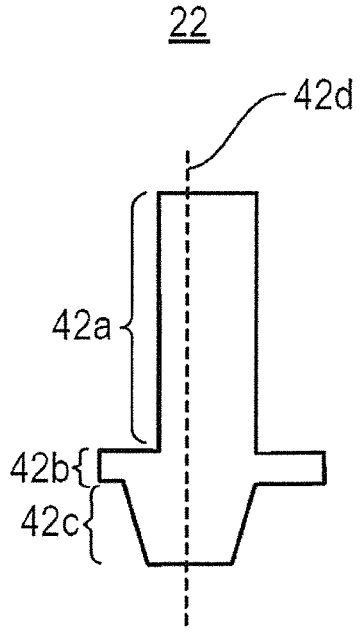

FIGS. 4A and 4B are side views illustrating a first eccentric pin and a second eccentric pin, respectively, of the printhead assembly of FIG. 2A according to examples. Referring to FIGS. 4A and 4B, in some examples, the first eccentric pin 11 and the second eccentric pin 22 may include a shaft portion 42*a*, an intermediate portion 42*b*, an offset portion 42*c*, and an axis of rotation 42*d*. The shaft portion 42*a* may be an elongated portion to be placed into the respective cavity such as a respective hollow sleeve of the printhead 11. The intermediate portion 42*b* may be disposed between the shaft portion 42*a* and the offset portion 42*c*. The offset portion 42 may be connected to the shaft portion 42*a* in an offset manner in which an axis of revolution 42*d* of the eccentric pin is displaced from its center so that it is capable of imparting reciprocating motion, for example, to the respective printhead 11.

In some examples, the respective eccentric pin 12 and 22 may be rotated such that the shaft portion 42*a* is rotated, for example, from being biased toward one side of a respective cavity, for example, to being biased toward the other side of the respective cavity by an amount to enable the printhead 11 to move a displacement distance to place the printhead 11 in an aligned state. In some examples, the respective eccentric pins 12 and 22 may be rotated by hand, a tool, and the like. For example, the misaligned state of a printhead 11 may be determined by a calibration image. Additionally, in some examples, a displacement distance to place the printhead 11 in an aligned state may be determined by open loop calibration methods, closed loop calibration methods, and the like. For example, a closed loop calibration method may include physically measuring the displacement distance (e.g., amount of misalignment) by a jig, and the like).

Figure 5:
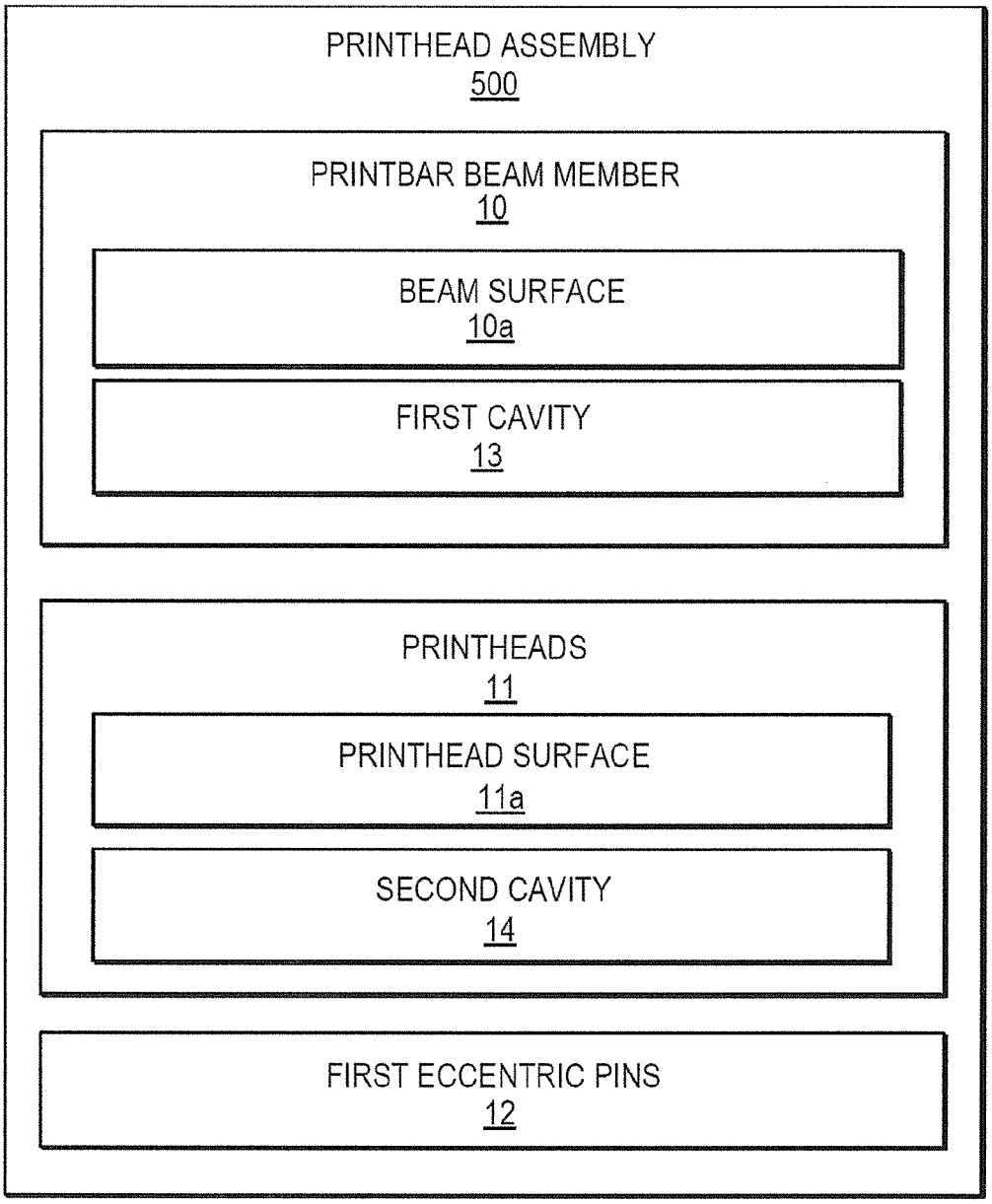
FIG. 5 is a block diagram illustrating a printhead assembly according to an example.
Figure 6:
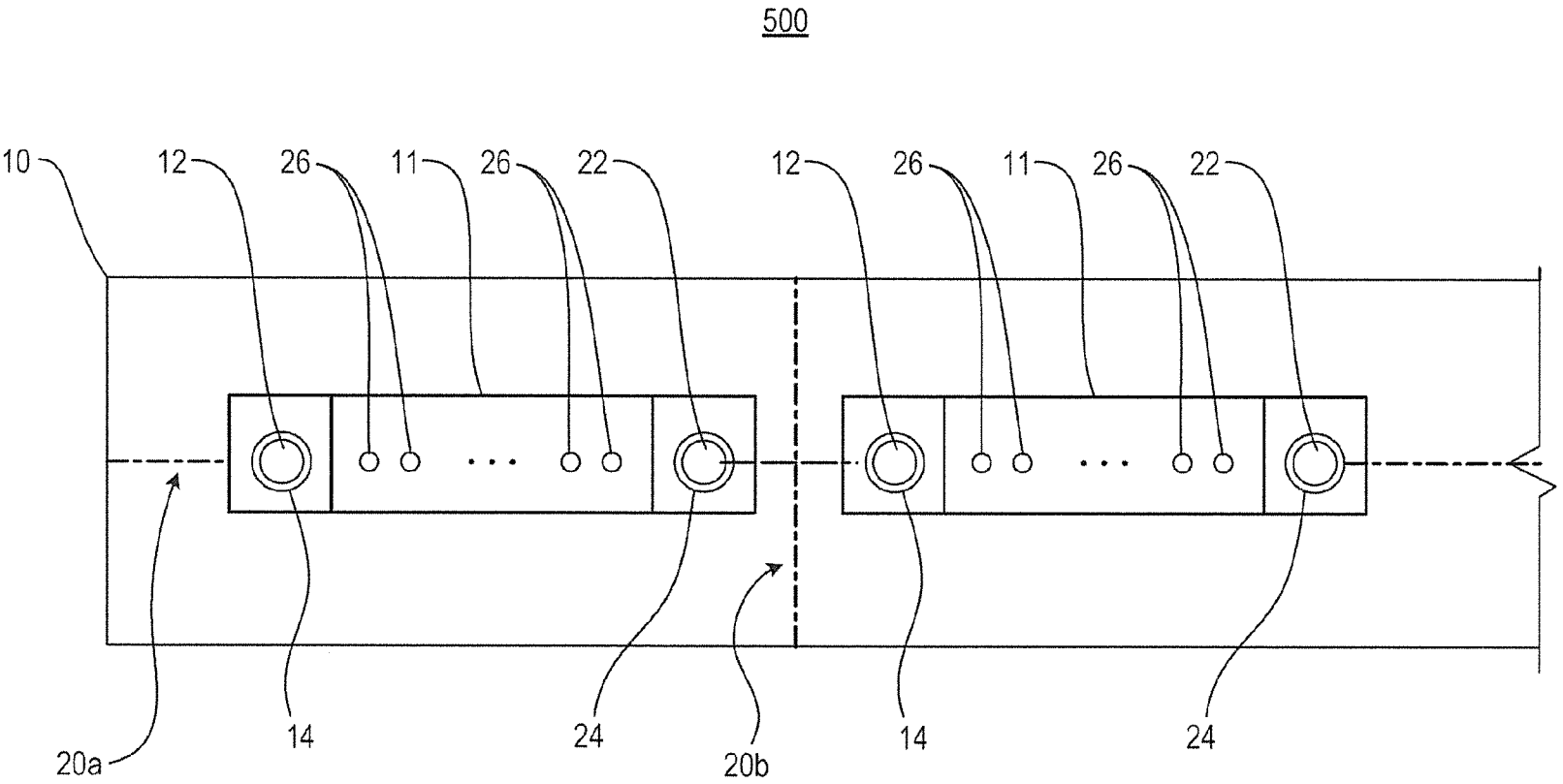
FIG. 6 is a top view illustrating a printhead assembly of FIG. 5 according to an example.

FIG. 5 is a block diagram illustrating a printhead assembly according to an example. FIG. 6 is a top view illustrating a printhead assembly according to an example. In some examples, a printhead assembly 500 may correspond to the printhead assemblies 100 and 200 as previously discussed with respective to FIGS. 1-4B and also include a plurality of printheads 11. Referring to FIGS. 5 and 6, in some examples, the printhead assembly 500 includes a printbar beam member 10, a plurality of printheads 11, and a plurality of first eccentric pins 12. The printbar beam member 10 may include a beam surface 10*a* and a plurality of first cavities 13 disposed through the beam surface 10*a*. Each one of the plurality of printheads 11 includes a printhead surface 11*a* and a second cavity 14 disposed through the respective printhead surface 11*a*. Each one of the plurality of first eccentric pins 12 may be inserted into the respective first cavity 13 and the corresponding second cavity 14 to couple the respective printhead 11 to the printbar beam member 10. Each one of the first eccentric pins 12 may be configured to rotate to adjust the respective position of the respect printhead 11 relative to the printbar beam member 10, for example, along a first axis 20*a* along the beam surface 10*a*.

Referring to FIGS. 5 and 6, in some examples, the printbar beam member 10 may also include a plurality of third cavities 23 disposed through the beam surface 10*a*. Each one of the printheads 11 may also include a fourth cavity 24 disposed through the respective printhead surface 11*a*. The printhead assembly 500 may also include a plurality of second eccentric pins 22. Each one of the second eccentric pins 22 may be inserted into the respective third cavity 23 and the corresponding fourth cavity 24 to couple the respective printhead 11 to the printbar beam member 10. In some examples, the first cavity 13 may be a first hollow sleeve, the second cavity 14 may be a second hollow sleeve, the third cavity 23 may be a third hollow sleeve, and a fourth cavity 24 may be a fourth hollow sleeve. In some examples, the first, second and fourth hollow sleeves may have a circular-shaped opening and the third hollow sleeve may have an oval-shaped opening.

Additionally, each one of the second eccentric pins 22 may be configured to rotate to adjust the respective position of the respective printhead 11 relative to the printbar beam member 10, for example, along a second axis 20*b* along the beam surface 10*a*. The second axis 20*b* may be different than the first axis 20*a*. In some examples, the second axis 20*b* may be in a printing direction and the first axis 20*a* may be traverse to the printing direction. In some examples, a rotation of the respective first and second eccentric pins 12 and 22 of the respective printhead 11 may be configured to move the respective printhead 11 along the printbar beam surface 10*a* relative to other printheads thereon.

Figure 7:
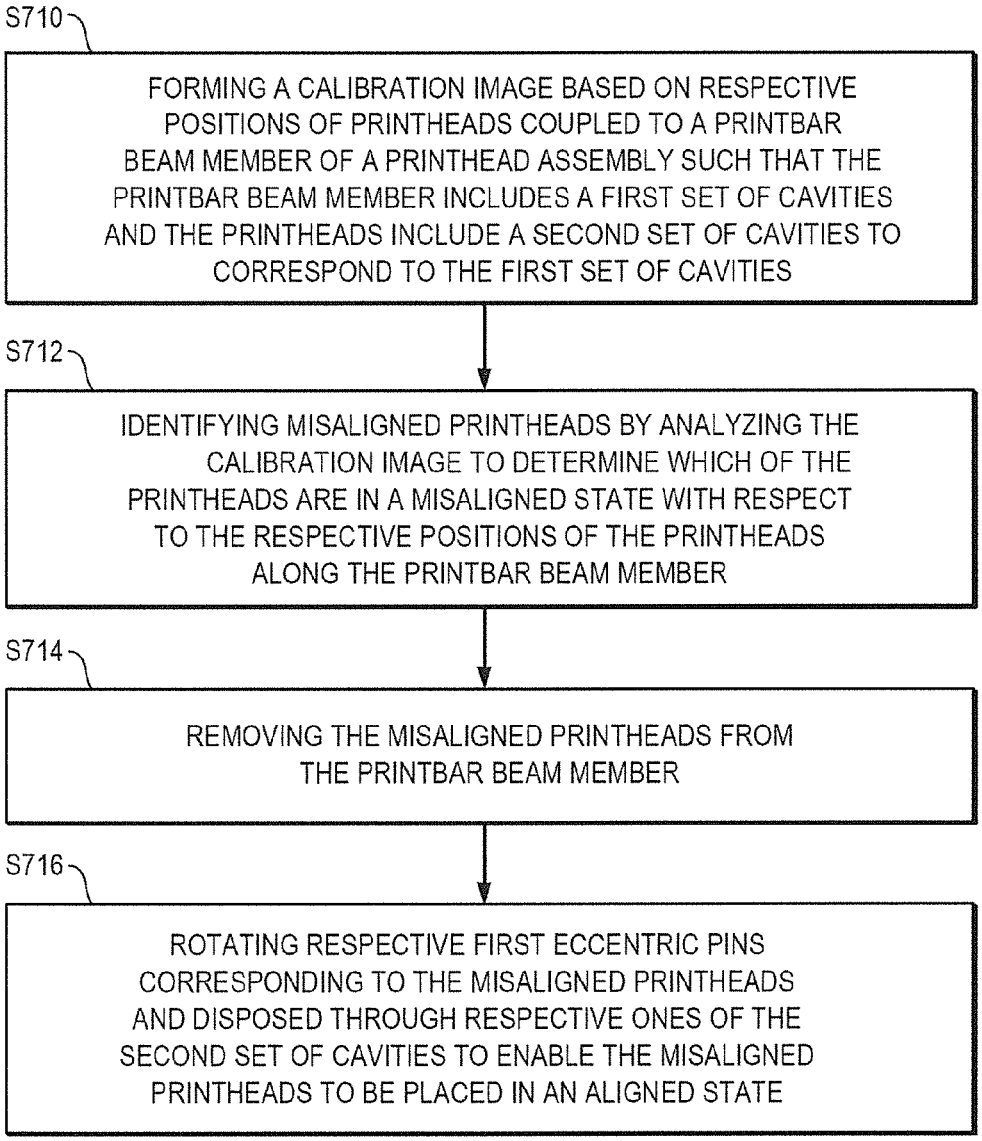
FIGS. 7 and 8 are flowcharts illustrating methods of calibrating a printhead assembly according to examples.

FIG. 7 is a flowchart illustrating a method of calibrating a printhead assembly according to an example. In some examples, the modules and/or assemblies implementing the method may be those described in relation to the printhead assemblies 100, 200 and 500 of FIGS. 1-6. In block S710, a calibration image is formed based on respective positions of printheads coupled to a printbar beam member of the printhead assembly such that the printbar beam member includes a first set of cavities and the printheads include a second set of cavities to correspond to the first set of cavities. In some examples, the first cavity may include a first hollow sleeve and the second cavity may include a second hollow sleeve. The calibration image may be printed onto a media by each one of the printheads. In block S712, the calibration image is analyzed to identify which of the printheads are in a misaligned state with respect to the respective positions of the printheads along the printbar beam member.

In block S714, the misaligned printheads are removed from the printbar beam member. In block S716, respective first eccentric pins corresponding to the misaligned printheads and disposed through respective ones of the second set of cavities are rotated to enable the misaligned printheads, for example, to be placed in an aligned state. In some examples, the method may also include engaging respective ones of the first set of cavities of the misaligned printheads by the respective first eccentric pins to place the misaligned printheads in the aligned state.

Figure 8:
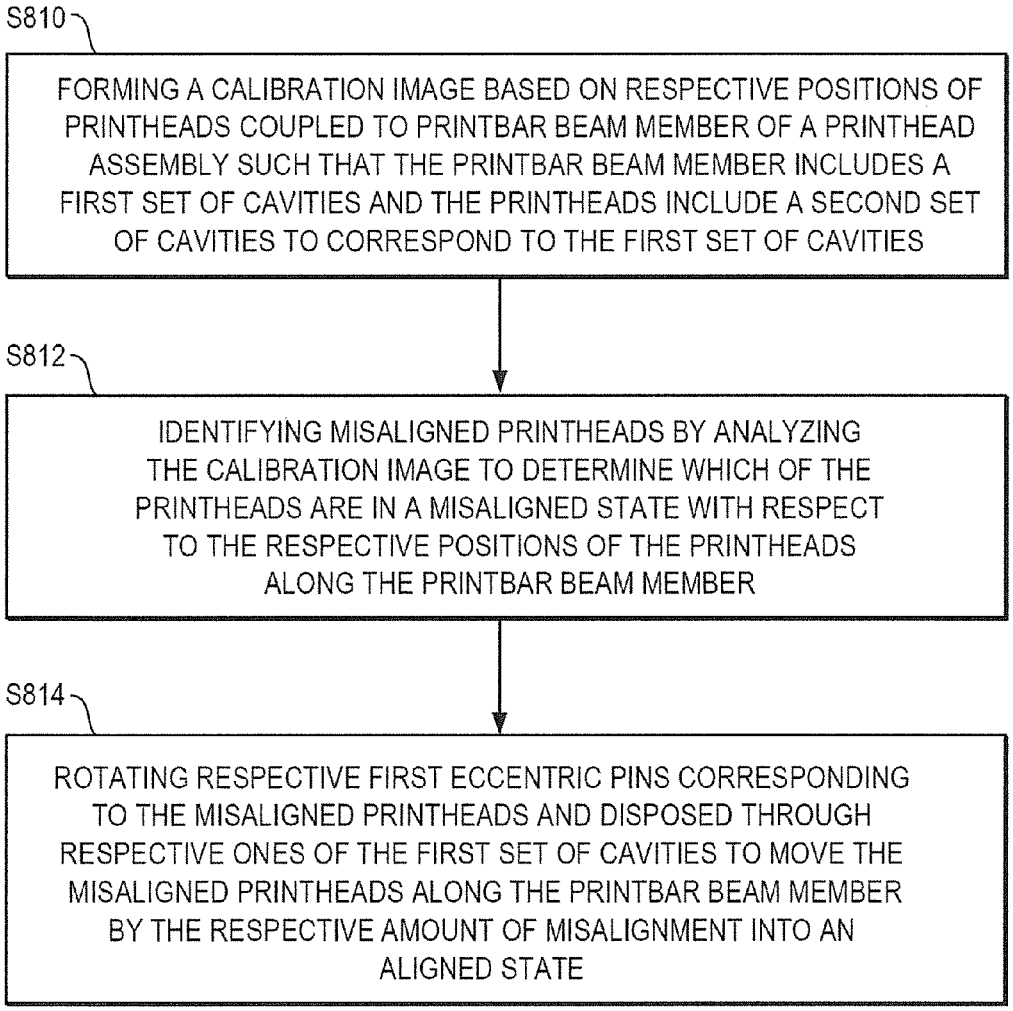

FIG. 8 is a flowchart illustrating a method of calibrating a printhead assembly according to an example. In some examples, the modules and/or assemblies implementing the method may be those described in relation to the printhead assemblies 100, 200 and 500 of FIGS. 1-6. In block S810, a calibration image is formed based on respective positions of printheads coupled to a printbar beam member of the printhead assembly such that the printbar beam member includes a first set of cavities and the printheads include a second set of cavities to correspond to the first set of cavities. In some examples, the first cavity may include a first hollow sleeve and the second cavity may include a second hollow sleeve. The calibration image may be printed onto a media by each one of the printheads. In block S812, misaligned printheads are identified by analyzing the calibration image to determine which of the printheads are in a misaligned state with respect to the respective positions of the printheads along the printbar beam member. In block S814, respective first eccentric pins corresponding to the misaligned printheads and disposed through respective ones of the first set of cavities are rotated to move the misaligned printheads along the printbar beam member by the respective amount of misalignment, for example, into an aligned state. In some examples, the method also includes determining an amount of misalignment (e.g., displacement distance) for each one of the misaligned printheads by performing an open loop calibration. Alternatively, in some examples, the method may include performing a closed loop calibration by physically measuring an amount of misalignment for each one of the misaligned printheads.

Figure 9:
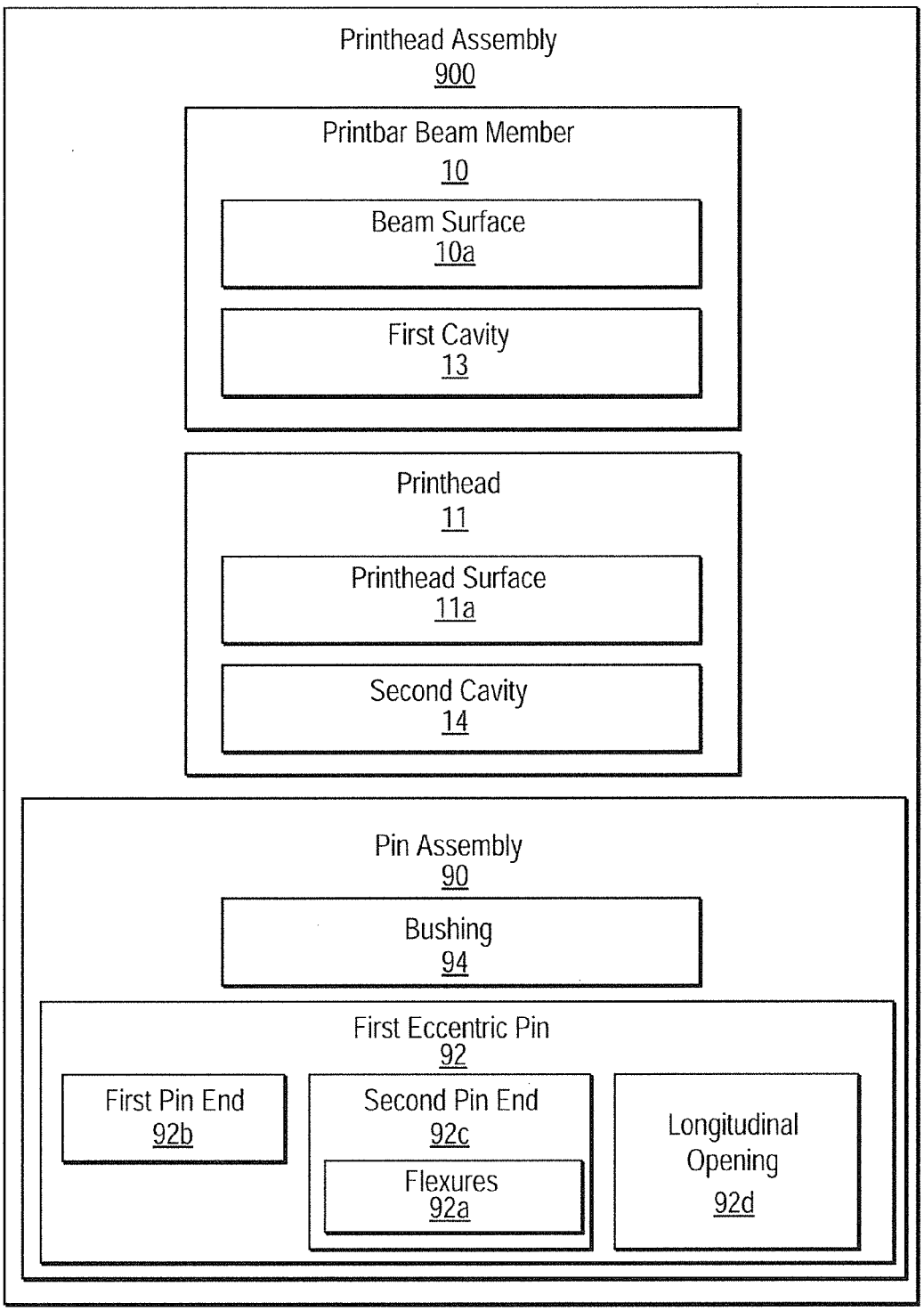
FIG. 9 is a block diagram illustrating a printhead assembly according to an example.

FIG. 9 is a block diagram illustrating a printhead assembly according to an example. Referring to FIG. 9, in some examples, a printhead assembly 900 includes a printbar beam member 10, a printhead 11, and a pin assembly 90. The printbar beam member 10 includes a beam surface 10*a* and a first cavity 13 disposed through the beam surface 10*a*. The printhead 11 includes a printhead surface 11*a* and a second cavity 14 disposed through the printhead surface 11*a*. The pin assembly 90 includes a bushing 94 and a first eccentric pin 92. The bushing 94 is disposed in the second cavity 14. For example, the bushing 94 may be glued to the printhead 11. The first eccentric pin 92 includes a first pin end 92*b*, a second pin end 92*c*, and a longitudinal opening 92*d* disposed between the first pin end 92*b* and the second pin end 92*a*. The first pin end 92*b* inserts into the first cavity 13. The second pin end 92*c* includes a plurality of flexures 92*a*. In some examples, the flexures 92*a* may include flexible pin portions to move relative to other portions of the first eccentric pin 92 and apply a force to surfaces in contact with the flexures 92*a*. The flexures 92*a* insert into the bushing 94 to couple the printhead 11 to the printbar beam member 10.

Referring to FIG. 9, in some examples, the first eccentric pin 92 is configured to rotate to adjust a position of the printhead 11 relative to the printbar beam member 10. For example, the printhead 11 may move along a first axis of the beam surface 10*a*. That is, the printhead 11 may move along the printbar beam member 10 in a cross-print direction. A position of the printhead 11 may be adjusted with respect to the printbar beam member 10 without removing it from contact therewith. Thus, additional positional errors of the printhead 11 due to the removing and replacing the printhead 11 on the printbar beam member 10 may be eliminated.

Figure 10:
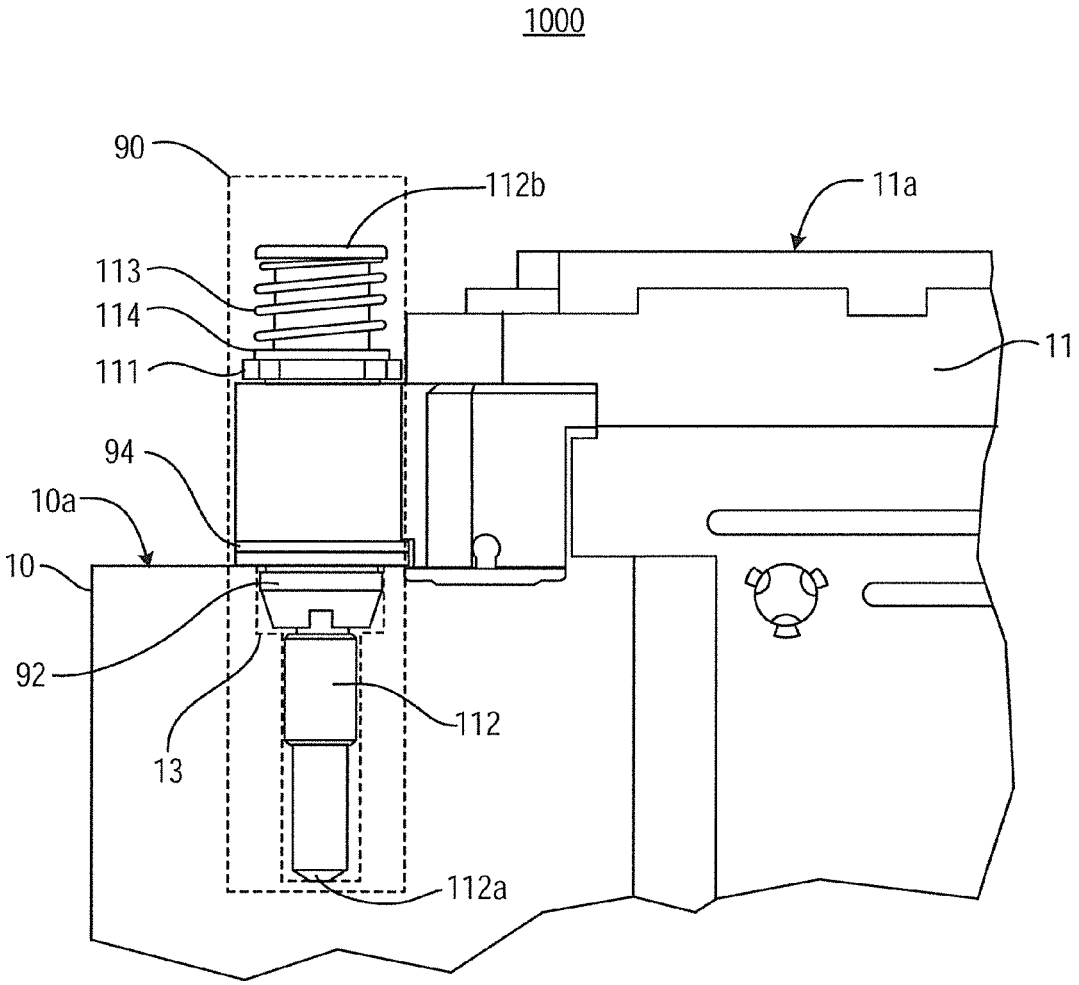
FIG. 10 is a schematic diagram illustrating a pin assembly of a printhead assembly in an assembled state according to an example.
Figure 11:
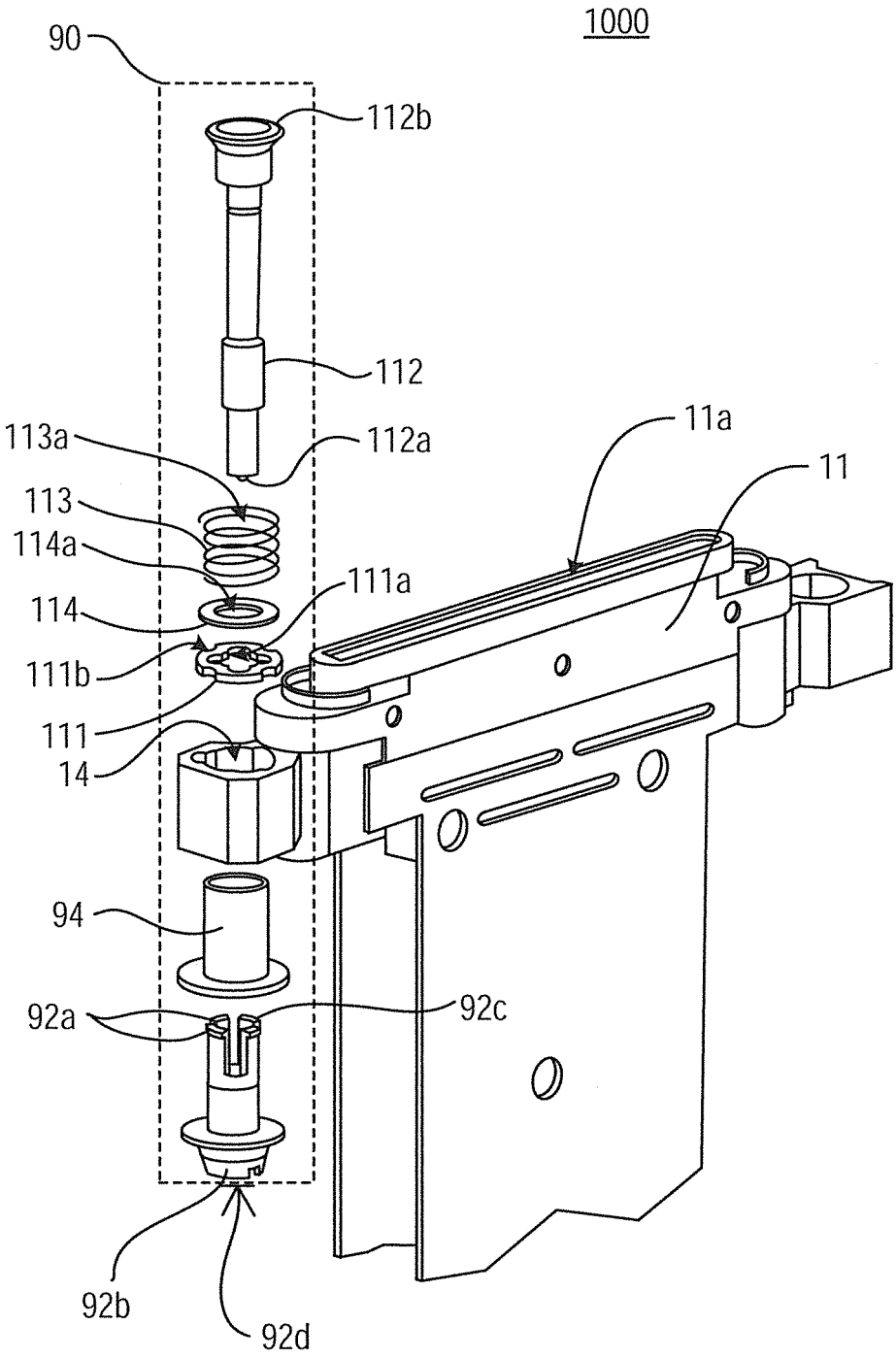
FIG. 11 is a schematic diagram illustrating a pin assembly of the printhead assembly of FIG. 10 in an unassembled state according to an example.

FIG. 10 is a schematic diagram illustrating a pin assembly of a printhead assembly in an assembled state according to an example. FIG. 11 is a schematic diagram illustrating a pin assembly of the printhead assembly of FIG. 10 in an unassembled state according to an example. The printhead assembly 1000 may include the printbar beam member 10, the printhead 11, and the pin assembly 90 as previously discussed with respect to the printhead assembly 900 of FIG. 9. For example, the pin assembly 1000 may include the bushing 94 and the first eccentric pin 92 as previously discussed with respect to the pin assembly 90 of the printhead assembly 900 of FIG. 9.

Referring to FIGS. 10 and 11, in some examples, the first eccentric pin 92 includes the first pin end 92*b* to insert into the first cavity 13, the second pin end 92*c* having the plurality of flexures 92*a*, and the longitudinal opening 92*d* disposed between the first pin end 92*b* and the second pin end 92*c* as previously discussed with respect to FIG. 9. The flexures 92*a* of the first eccentric pin 92 enable a friction-fit engagement between the first eccentric pin 92 and the bushing 94 coupled to the printhead 11. The flexures 92*a* also enable a transition of torque from an upper side of the printhead 11. In some examples, the plurality of flexures 92*a* includes four flexures. The first eccentric pin 92 may also include a threaded surface such as a respective tapping adjacent to the longitudinal opening 92*d* to receive a screw 112 such as a compatible threaded portion thereof. Thus, the threaded surface may enable a captive connection with the screw 112.

Referring to FIGS. 10 and 11, in some examples, the pin assembly 90 may also include a torsion ring 111, a screw 112, a spring 113, and a slip ring 114. The torsion ring 111 is coupled to the second pin end 92*c* of the first eccentric pin 92 to transmit torque to the first eccentric pin 92. The torsion ring 111 includes an interior grooved opening 111*a* and an exterior grooved perimeter 111*b*. The exterior grooved perimeter 111*b* of the torsion ring 111 is configured to receive a printhead adjustment tool 1200 to rotate the torsion ring 111 to transmit torque to the torsion ring 111. The screw 112 is disposed through the interior grooved opening 111*a* of the torsion ring 111 and the longitudinal opening 92*d* of the first eccentric pin 92.

Referring to FIGS. 10 and 11, in some examples, the screw 112 includes a first screw end 112*a* such as a tip and a second screw end 112*b* such as a head. In some examples, the screw 112 may include an M3-type screw. The spring 113 includes a longitudinal spring opening 113*a* to engage the screw 112. The spring 113 is disposed between the second screw end 112*b* and the torsion ring 111 to apply a force to hold the printhead 11 to the printbar beam member 10. Thus, the printhead 11 may move when the first eccentric pin 92 is rotated while, at other times, the printhead 11 may maintain a fixed position due to the force between the printhead 11 and the printbar beam member 10. In some examples, the force applied by the spring 113 is about thirty newtons. In some examples, the printhead assembly 1000 may include an additional pin assembly with respect to the other side of the respective printhead 11 to enable further adjustment of the position of the printhead with respect to the printbar beam member 10.

Referring to FIGS. 10 and 11, in some examples, the first screw end 112*a* may engage the printbar beam member 10 to maintain the second screw end 112*b* at a height equal to or below a height of the printhead surface 11*a*. That is, the screw 112, in a properly assembled state, may not extend above the printhead surface 11*a*. The slip ring 114 includes an opening 114*a* to receive the screw 112. The slip ring 114 is disposed between the spring 113 and the torsion ring 111 to limit an amount of torque applied to the screw 112, for example, while manipulating the first eccentric pin 92. In some examples, the rotary nature of the pin assembly 90 may enable the printhead position to be self-locked and secured against thermal expansion.

Figure 12:
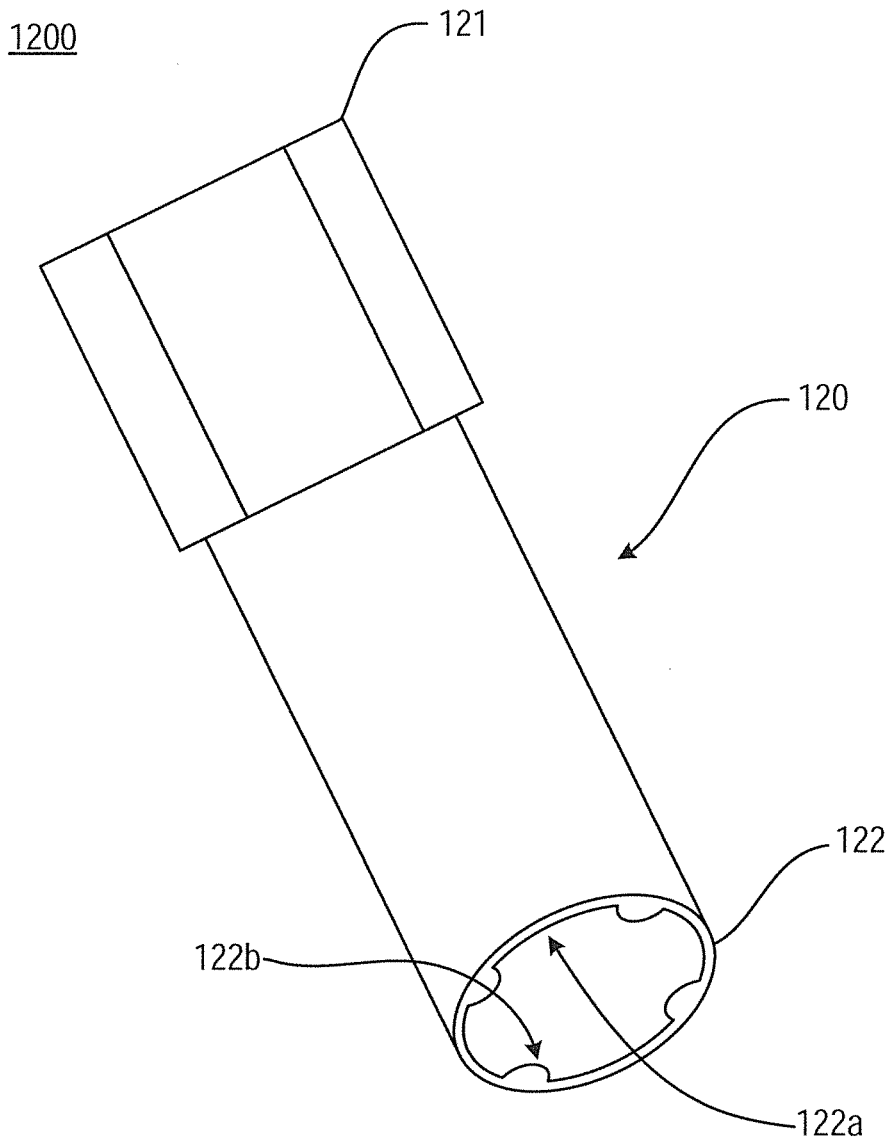
FIG. 12 is a perspective view illustrating a printhead alignment tool usable with a printhead assembly according to an example.

FIG. 12 is a perspective view illustrating a printhead alignment tool usable with a printhead assembly according to an example. Referring to FIG. 12, in some examples, a printhead alignment tool 1200 includes a main body 120. The main body 120 includes an upper tool end 121 and a lower tool end 122. In some examples, the upper tool end 121 may include a shape such as a polygon to assist in turning the main body 120 manually and/or with another tool such as a wrench. The lower tool end 122 includes a cavity 122*a* and a torsion ring engagement surface 122*b*. The cavity 122*a* receives at least a portion of the pin assembly 90. The torsion ring engagement surface 122*b* includes a shape to mate and engage with the exterior grooved perimeter 111*b* of the torsion ring 111. The main body 120 is configured to rotate to apply torque to the torsion ring 111 to rotate the first eccentric pin 92 to adjust a position of a printhead 11 relative to a printbar beam member 10.

Figure 13:
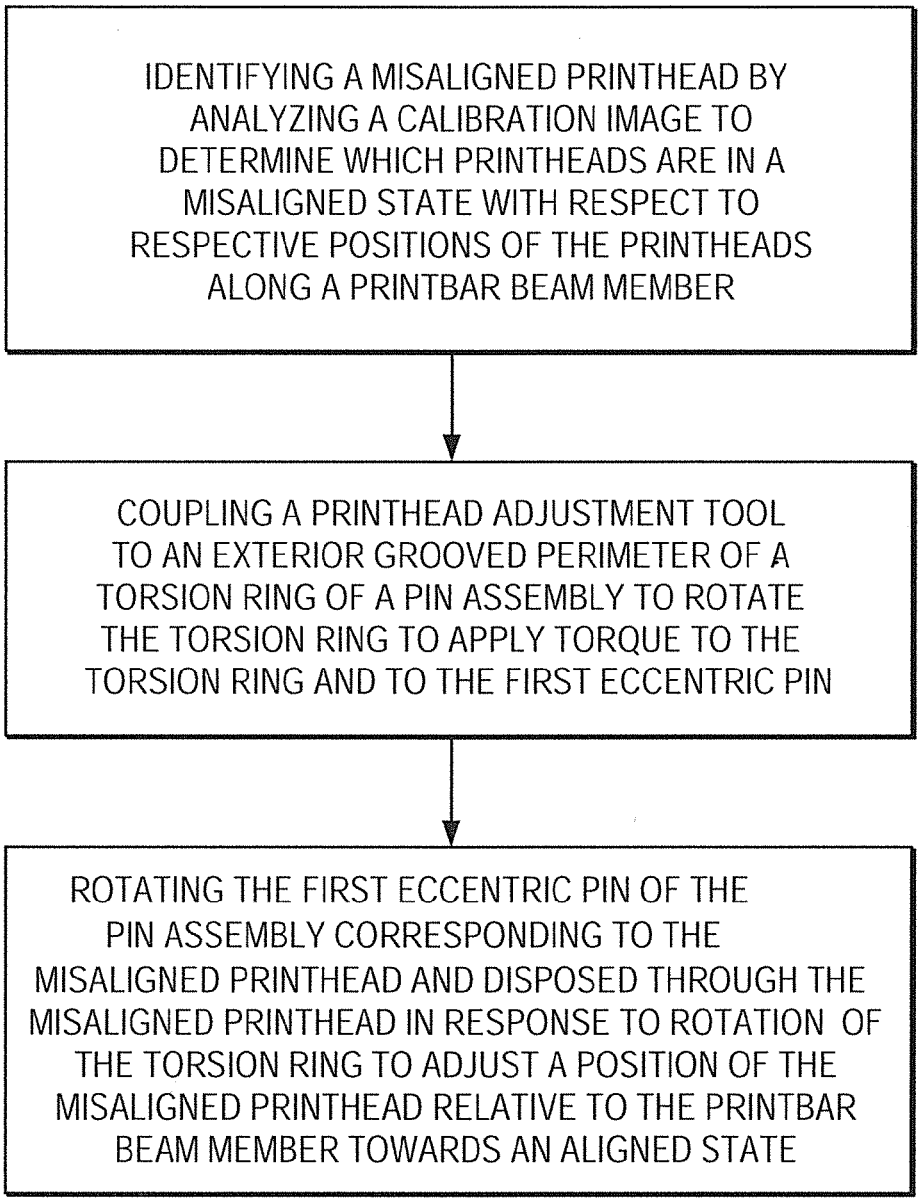
FIG. 13 is a flowchart of a method of aligning a misaligned printhead according to an example.

FIG. 13 is a flowchart of a method of aligning a misaligned printhead according to an example. In some examples, the modules and/or assemblies implementing the method may be those described in relation to the printhead assemblies 900 and 1000 of FIGS. 9-12. In block S1300, a misaligned printhead is identified by analyzing a calibration image to determine which printheads are in a misaligned state with respect to respective positions of the printheads along a printbar beam member. In block S1310, a printhead adjustment tool couples to an exterior grooved perimeter of a torsion ring of a pin assembly to rotate the torsion ring to apply torque to the torsion ring and to the first eccentric pin. In some examples, the coupling of the exterior grooved perimeter and rotation of the torsion ring are performed while the printhead is disposed on a beam surface of the printbar beam member. In block S1320, the first eccentric pin of the pin assembly corresponding to the misaligned printhead and disposed through the misaligned printhead is rotated in response to rotation of the torsion ring to adjust a position of the misaligned printhead relative to the printbar beam member towards an aligned state.

It is to be understood that the flowcharts of FIGS. 7, 8, and 13 illustrate architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowcharts of FIGS. 7, 8, and 13 illustrate a specific order of execution, the order of execution may differ from that which is depicted. For example, the order of execution of two or more blocks may be rearranged relative to the order illustrated. Also, two or more blocks illustrated in succession in FIGS. 7, 8, and 13 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A printhead assembly, comprising:

a printbar beam member having a beam surface and a first cavity disposed through the beam surface;

a printhead having a printhead surface and a second cavity disposed through the printhead surface; and a pin assembly, including:

a bushing disposed in the second cavity;

a first eccentric pin including a first pin end to insert into the first cavity, a second pin end having a plurality of flexures to insert into the second cavity to couple the printhead to the printbar beam member, and a longitudinal opening disposed between the first pin end and the second pin end; and wherein the first eccentric pin is to rotate to adjust a position of the printhead relative to the printbar beam member.

2. The printhead assembly of claim 1, wherein the pin assembly further comprises:

a torsion ring coupled to the second end of the first eccentric pin to transmit torque to the eccentric pin, the torsion ring including an interior grooved opening and an exterior grooved perimeter.

3. The printhead assembly of claim 2, wherein the exterior grooved perimeter of the torsion ring is configured to receive a printhead adjustment tool to rotate the torsion ring to transmit torque to the torsion ring.

4. The printhead assembly of claim 3, wherein the screw further comprises:

an M3-type screw.

5. The printhead assembly of claim 3, wherein the pin assembly further comprises:

a spring having a longitudinal spring opening to engage the screw, the spring disposed between the second screw end and the torsion ring to apply a force to hold the printhead to the printbar beam member.

6. The printhead assembly of claim 5, wherein the force applied by the spring is about thirty newtons.

7. The printhead assembly of claim 5, wherein the pin assembly further comprises:

a slip ring having an opening to receive the screw, the slip ring is disposed between the spring and the torsion ring to limit an amount of torque applied to the screw.

8. The printhead assembly of claim 3, wherein the first screw end is configured to engage the printbar beam member to maintain the second screw end at a height equal to or below a height of the printhead surface.

9. The printhead assembly of claim 3, wherein the first eccentric pin further comprises: a threaded surface adjacent to the longitudinal opening to receive the screw.

10. The printhead assembly of claim 2, wherein the pin assembly further comprises:

a screw including a first screw end and a second screw end, the screw is disposed through the interior grooved opening of the torsion ring and the longitudinal opening of the first eccentric pin.

11. The printhead assembly of claim 1, wherein the flexures of the first eccentric pin enable a friction-fit engagement between the first eccentric pin and the bushing coupled to the printhead, and enable a transition of torque from an upper side of the printhead.

12. The printhead assembly of claim 1, wherein the plurality of flexures comprises: four flexures.

13. A printhead alignment tool usable with a printhead assembly including a pin assembly, wherein the pin assembly includes a bushing, an eccentric pin, and a torsion ring, the printhead alignment tool comprising:

a main body including an upper tool end and a lower tool end, the lower tool end including a cavity and a torsion ring engagement surface;

the cavity to receive the bushing and an end of the eccentric pin of the pin assembly, wherein the end of the eccentric pin includes a plurality of flexures; and the torsion ring engagement surface including a shape to mate and engage with an exterior grooved perimeter of the torsion ring; and wherein the main body is to rotate to apply torque to the torsion ring to rotate the eccentric pin to adjust a position of a printhead relative to a printbar beam member.

14. A method of aligning a misaligned printhead, the method comprising:

identifying a misaligned printhead by analyzing a calibration image to determine which printheads are in a misaligned state with respect to respective positions of the printheads along a printbar beam member;

coupling a printhead adjustment tool to an exterior grooved perimeter of a torsion ring of a pin assembly to rotate the torsion ring to apply torque to the torsion ring, wherein the pin assembly further comprises an eccentric pin including a first end inserted into a cavity of the printbar beam member, a second end having a plurality of flexures inserted into a cavity of the printhead, and a longitudinal opening disposed between the first end and the second end;

inserting a screw through an interior grooved opening of the torsion ring and the longitudinal opening of the eccentric pin; and rotating the eccentric pin of the pin assembly corresponding to the misaligned printhead and disposed through the misaligned printhead in response to rotation of the torsion ring to adjust a position of the misaligned printhead relative to the printbar beam member towards an aligned state.

15. The method of claim 14, wherein the coupling of the exterior grooved perimeter and rotation of the torsion ring are performed while the printhead is disposed on a beam surface of the printbar beam member.

* * * * *